United States Patent [19]

Sandino

[11] 4,262,918

[45] Apr. 21, 1981

[54] UNITARY MOLDED SKATE CHASSIS

[76] Inventor: Hector M. Sandino, 24451 Peacock St., El Toro, Calif.

[21] Appl. No.: 65,738

[22] Filed: Aug. 10, 1979

[51] Int. Cl.[3] ..... A63C 17/02

[52] U.S. Cl. ..... 280/11.26; 280/11.28; 403/364

[58] Field of Search ..... 280/11.28, 11.26, 11.27, 280/11.19; 403/364, 339

[56] References Cited

U.S. PATENT DOCUMENTS

| | | | |
|---|---|---|---|
| 280,821 | 7/1883 | Higgins | 280/11.28 |
| 320,108 | 6/1885 | Williams | 280/11.19 |
| 1,807,890 | 6/1931 | Berger | 280/11.26 |
| 3,355,195 | 11/1967 | Takayanagi et al. | 403/364 |
| 3,649,038 | 3/1972 | Huckenbeck | 280/11.28 |
| 3,953,041 | 4/1976 | Buss | 280/11.26 |
| 4,061,350 | 12/1977 | Schmidt, Jr. et al. | 280/87.04 A |
| 4,146,241 | 3/1979 | Stevenson | 280/11.27 |
| 4,168,842 | 9/1979 | Kimmell et al. | 280/11.28 |

FOREIGN PATENT DOCUMENTS

| | | | |
|---|---|---|---|
| 6670 | 12/1875 | France | 280/11.27 |
| 496224 | 7/1919 | France | 280/11.23 |

*Primary Examiner*—Randolph A. Reese
*Assistant Examiner*—D. W. Underwood
*Attorney, Agent, or Firm*—Knobbe, Martens, Olson, Hubbard & Bear

[57] ABSTRACT

A one-piece, plastic molded, roller skate chassis, including foot plate, trucks, and wheel axles. Each truck, which provides for turning in a conventional manner, includes a cylindrical torsional member, inclined at a predetermined angle with respect to the foot plate, and a shank attached at one end to the torsion member and at the opposite end to a cylindrical shaft which receives the axle of the roller skate. The plastic from which the present chassis is molded is tough and durable, and yet sufficiently flexible and resilient to allow turning. Also disclosed is an adjustable two-piece skate chassis in which each mating member is on a one-piece, molded plastic molded construction.

17 Claims, 10 Drawing Figures

Fig. 1
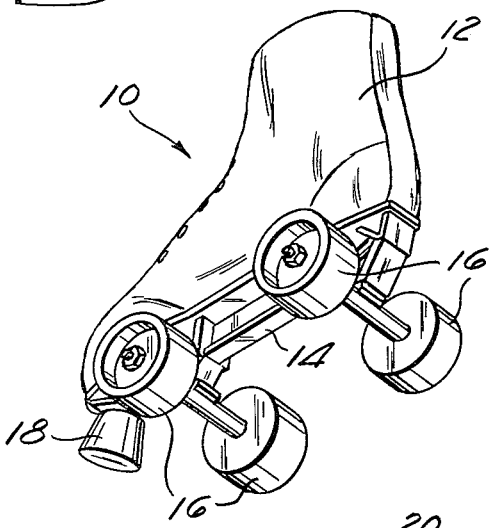
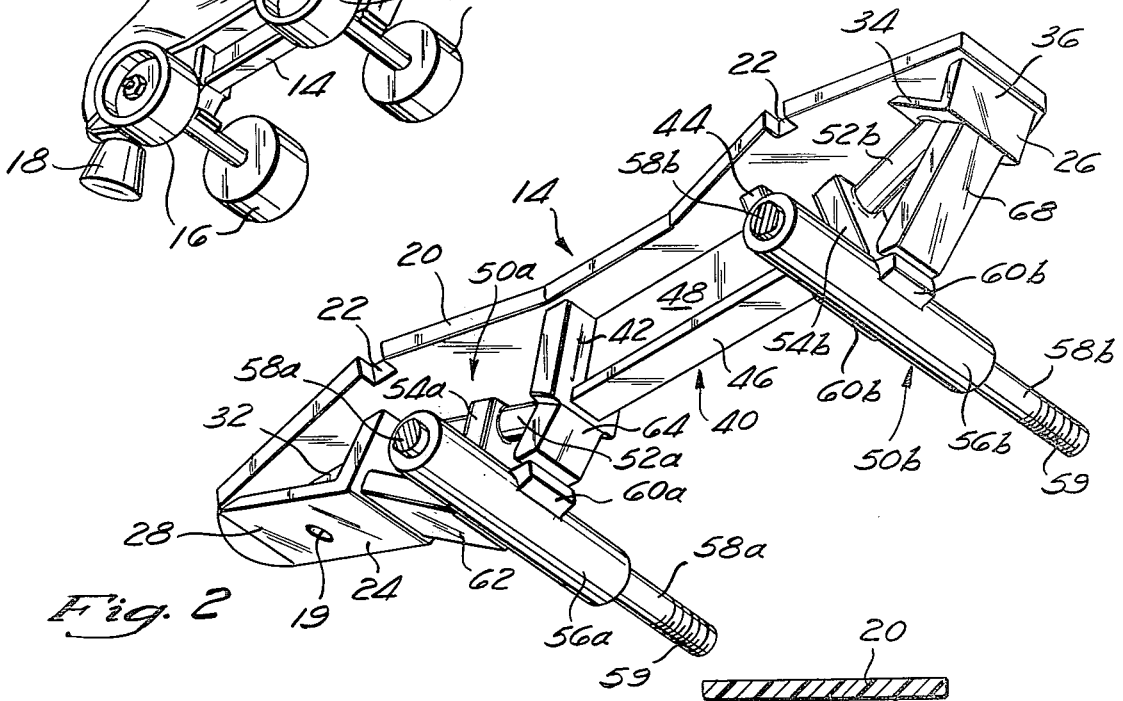
Fig. 2
Fig. 4
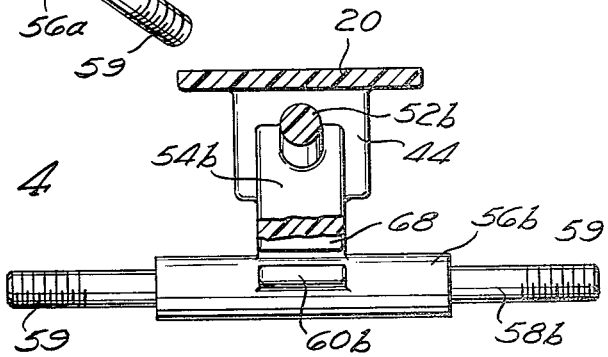
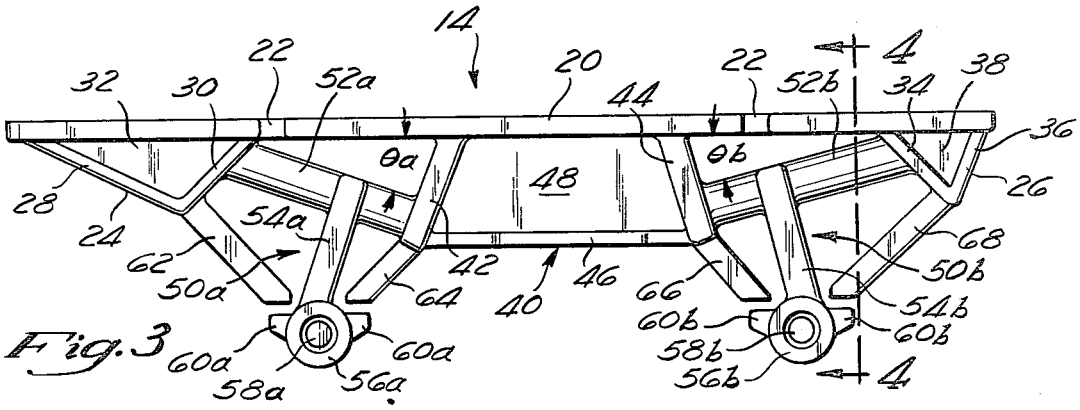
Fig. 3

Fig. 5
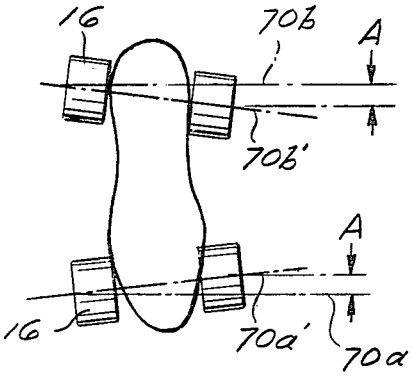
Fig. 6
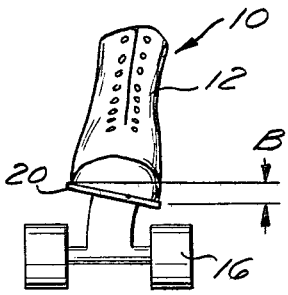
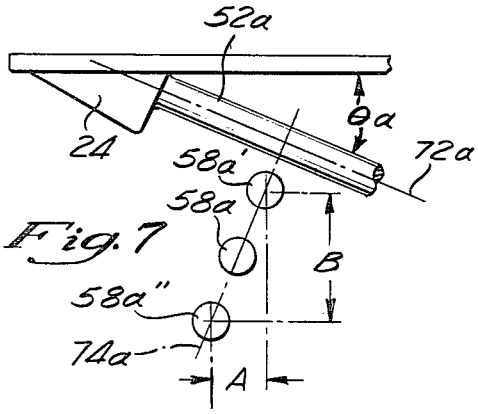
Fig. 7
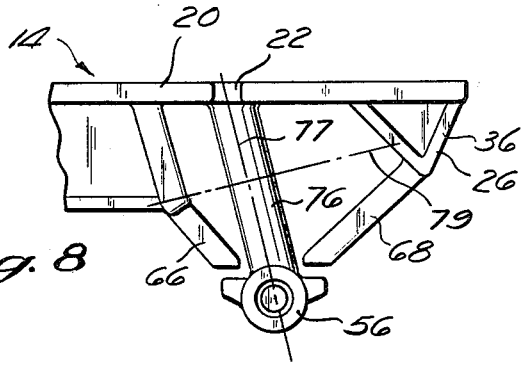
Fig. 8
Fig. 9
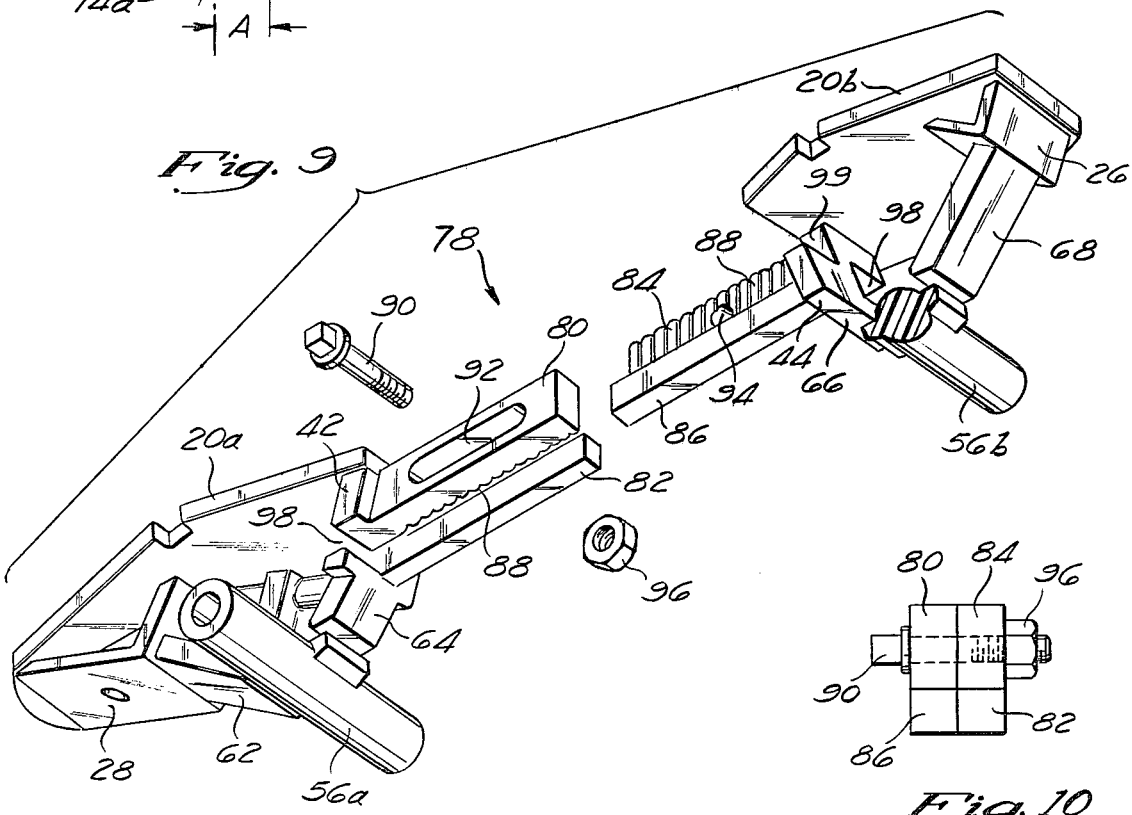
Fig. 10

UNITARY MOLDED SKATE CHASSIS

BACKGROUND OF THE INVENTION

The present invention relates to a roller skate chassis and, more particularly, to a unitary, plastic molded chassis which is durable, less expensive to manufacture, and whose performance is very comparable to chasses of conventional construction.

The United States has recently witnessed a tremendous surge in the popularity of roller skating. Although this activity is still just as popular as it probably ever was among children, the recent rise in popularity has primarily been among teenagers and young adults. As a result, roller skates are currently being used for a wider range of purposes, such as dancing and transportation, as well as for the traditional purpose of recreation.

This surge in roller skating popularity has received wide-spread public notoriety, and was referred to on the cover of one weekly news magazine as "Roller Mania". Naturally, there has been a tremendous increase in roller skate sales and in the establishment of skating rinks. Some cities have even established special roller skating lanes, adjacent to heavily travelled pedestrian sidewalks, for the exclusive use of roller skaters and skateboarders who have chosen this alternate mode of transportation. In response to this new found popularity, roller figure skating and speed skating were, for the first time, competitive events in the Pan American games, and it is anticipated that these events will also be part of the 1980 Olympic games.

The increased participation in roller skating has been prompted in part by the development of polyurethane wheels and improved truck and bearing assemblies which have provided new dimensions of speed and manuverability to the sport of roller skating. In the past, however, roller skate foot plates and truck assemblies were typically constructed from metal by the use of casting process. Although these truck assemblies performed adequately, they were relatively expensive to manufacture.

Therefore, paralleling this rise in popularity has been an increasing public demand for less expensive roller skating equipment which nonetheless is durable and offers the same advantages of speed and manuverability as conventional roller skates.

SUMMARY OF THE PRESENT INVENTION

The present invention consists of a roller skate foot plate and truck which is of a one-piece, plastic molded construction. The unitary plate and truck provide a chassis which is relatively inexpensive to manufacture, as compared with roller skates of the prior art, and yet is just as durable and manuverable.

The chassis of the present invention is constructed from a tough, durable plastic, which is also sufficiently flexible and resilient to provide for turning. Because of its unitary construction, the present chassis is easier to assemble than previous chasses in that no subassembly of the truck to the plate is required. The present invention is also able to take advantage of recent improvements in wheels and bearings to yield a roller skate which exhibits all of the characteristics of speed and manuverability of conventional skates. Furthermore, the lightness of the plastic construction of the present chassis provides for a skate which is superior to the prior art in terms of these important characteristics.

The chassis of the present invention consists of a foot plate, two spaced wheel trucks suspended beneath the plate and an axle in each truck which receives the wheels of the chassis. The axles are made of metal and are placed in the mold at the time the present invention is molded so that they become and integral part of the unitary construction. The foot plate is provided with means for attaching the chassis to the sole of a shoe or other foot-receiving component of a complete roller skate.

The truck of the present invention consists of a torsional member which is inclined with respect to the foot plate and supported at each end by structural members extending below the foot plate. Attached to the central portion of the torsional member is a shank which extends further downward and connects it to a cylindrical axle mount.

The present truck provides for turning in generally the same manner as conventional roller skates. As the skater shifts his weight and leans to one side during turning, the foot plate tends to rotate about the torsional member which in turn causes the wheel axles to converge toward one another on that side. This convergence causes the skate to turn in the direction the skater has leaned.

The torsional member can be inclined at various angles relative to the foot plate, thereby providing for more or less ease in turning, as desired by the individual. However, stops are provided which act in conjunction with tabs on the axle mounts to prevent the skater from leaning dangerously too far to one side or the other. Furthermore, the torsional member supplies a suspension system for the roller skate since it is able to flex in response to uneven forces acting through the wheels, axle and shank. In this regard, the thickness of the torsional member can be adjusted according to the weight of the individual skater.

An alternate skate truck, which also forms a one-piece chassis with the foot plate, consists of only a shank which is attached directly to the bottom of the plate and inclined with respect thereto. This truck embodiment turns in the same manner as that described except that the shank flexes about an imaginary axis of rotation which is perpendicular to its longitudinal dimension and which forms a vertical plane with the longitudinal axis of the foot plate.

The present invention also includes a novel adjustable roller skate chassis. An adjustable chassis is desirable when a single chassis is being manufactured for attachment to various sizes of shoes. Furthermore, on some occassions, the plate of the chassis is attached to a larger foot plate which is adapted to receive the street shoe of a roller skater, as opposed to a skating shoe. Therefore, it is desirable that the chassis of such a roller skate be adjustable in order to accommodate various foot sizes of individual skaters.

Two separate plate and truck assemblies of unitary construction are each provided with a pair of horizontally extending beams which slidably interlock to provide a range of adjustment. The beams of each assembly are diagonally arranged with respect to each other such that when mated with the beams of the opposing assembly, each individual beam is contiguous with the beams of the opposite assembly.

This diagonal interlocking arrangement prevents horizontal and vertical movement of the beams in a direction transverse to the skate's length and provides for a rigidly secure chassis. A bolt is inserted through apertures in mating beams in order to lock the assembly together and to prevent movement in the longitudinal direction. The interface surfaces of adjacent beams can also be provided with serations to further discourage such longitudinal movement. Finally, in order to provide even further security, apertures in each assembly can be provided to receive the ends of the beam from the opposing assembly.

These and other advantages of the present invention are apparent by reference to the drawings in which:

FIG. 1 is a perspective view of the chassis of the present invention shown with a shoe and wheels attached to form a complete roller skate;

FIG. 2 is a perspective view of the roller skate chassis of the present invention;

FIG. 3 is a side view of the present roller skate chassis;

FIG. 4 is a sectional view taken along line 4—4 illustrating the comparative dimensions of the truck components of the present invention;

FIG. 5 is a schematic plan view illustrating the manner in which the axles converge to cause a roller skate to turn;

FIG. 6 is a schematic front view illustrating the manner in which a skater leans in order to effect the turning shown in FIG. 5;

FIG. 7 is a schematic side view of a portion of the present chassis illustrating how the rotation of the foot plate causes the convergence of the wheel axles shown in FIG. 5;

FIG. 8 is a side view of a portion of a roller skate chassis showing an alternate truck embodiment;

FIG. 9 is an exploded perspective view of an adjustable roller skate chassis; and FIG. 10 is a schematic view illustrating the manner in which the shafts of the adjustable chassis of FIG. 9 mate.

DETAILED DESCRIPTION OF THE PREFERRED EMBODIMENT

FIG. 1 depicts a complete roller skate 10 consisting of a shoe member 12 for receiving the foot of the skater, a chassis 14 attached to the bottom of the shoe, and wheels 16 attached to the chassis 14. A toe stop 18 provides means for braking the motion of the roller skate.

FIG. 2 is a perspective view of the unitary chassis 14 of the present invention. In the preferred embodiment, the chassis 14 is molded from a tough, strong plastic such as Dupont's "Nylon Super Tough", ST801. The use of the plastic provides for an inexpensive, durable roller skate which is also light, thereby enhancing its speed and manuverability. The one-piece construction of these chassis can be described in detail by reference to FIGS. 2, 3 and 4.

Referring initially to FIG. 2, a planar foot plate 20 is shown which is shaped generally like the bottom of a foot except it is symmetrical about its longitudinal axis. The plate 20 is narrow in its central portion and wider in its forward and rearward portions so as to provide additional support for the truck and wheel assemblies, and shoe 12, to be described in more detail below, suspended beneath it. Slots 22 are cut out the periphery of the plate 20 and located on both sides thereof. The plate 20 is attached to the sole of the shoe 12 by means of the slots 22 which receive threaded screws or rivets (not shown).

Prominently shown in FIG. 2 are front and rear axle mounts **56*a* and 56*b*, respectively, which are part of the front and rear trucks. The axle mounts 56*a* and 56*b* receive front and rear axles 58*a* and 58*b*, respectively, on which wheels 16 are mounted, as shown in FIG. 1. In the preferred embodiment, axles 58 are made of metal and loaded into the die before the chassis 14** is molded so that they need not be assembled later.

FIGS. 2 and 3 depict triangular braces 24 and 26 located beneath the toe and heel portions, respectively, of the foot plate 20. The front brace 24 consists of a front rectangular beam 28 and a rear rectangular beam 30 formed beneath the plate 20 in a V-shaped structure which is strengthened by a web 32. Similarly, rear brace 26 consists of front and rear rectangular beams 34 and 36, respectively, formed in the shape of a V, and a web portion 38. The front beam 28 of the front brace 24 has an aperture 19 and a larger surface area than other beam members of the braces 24 and 26 in order to accommodate attachment of the toe stop 18, shown in FIG. 1.

Referring particularly to FIG. 3, beneath the central portion of the plate 20 is attached a trapezoidal support section 40 consisting of a forward leg 42 and a rear leg 44 joined by means of a horizontal flange 46. As with the braces 24 and 26, the framework of this support section 40 is reinforced by means of a web 48.

Suspended beneath the plate 20 and mounted between each brace 24 and 26 and the support section 40 are front and rear truck assemblies **50*a* and 50*b*, respectively, shown best in FIG. 3. Each truck 50 consists of a torsional member 42 which is inclined with respect to plate 20, and a shank 54 which is attached at one end to the torsional member 42 and at the other other end to axle mount 56. As described above, the axle mounts 56 receive axles 58 on which are mounted the wheels 16. The axles 58 have threaded end portions 59 which receive nuts (not shown) to securely hold the wheels 16 in place. As will be described in connection with FIGS. 5, 6 and 7, the trucks 50 work in cooperation with the plate 20** to provide for turning of the roller skate in the direction the skater leans.

Referring again to FIG. 3, the torsional member **52*a* of the front truck 50*a* is mounted in a struct-like fashion between the base of the beam 30 of the front brace 24 and the lower end of the front leg 42 of the support section 40. It is disposed midway between and parallel to the longitudinal sides of the plate 20. The torsional member 52*a* and the plate 20 form an acute angle $\theta a$ which opens toward the rear of the chassis 14. Attached just rearward of the middle of the torsional member 42*a* and extending downwardly, essentially at a right angle with respect wardly, essentially at a right angle with respect thereto, is shank 54*a*. Attached to the lower end of the shank 54*a* is axle mount 56*a* consisting of an elongate cylindrical shaft lying transverse to the length of the plate 20, as shown in FIG. 4, which retains the front axle 58*a***.

The rear truck **50*b* is identical in construction to the front truck 50*a*; however, it is mounted beneath the plate 20 so as to face in the opposite direction. That is, the angle $\theta b$ that rear torsional member 52*b* makes with respect to the plate 20 opens toward the front of the chassis 14, as shown in FIG. 3. As will be described in more detail below, this arrangement of the torsional members with respect to the plate 20** enables the skater to turn in the direction in which he leans on the roller skate. Furthermore, the ease with which turning is accomplished depends upon the acuteness of the above-described angles, which in the preferred embodiment are equal.

As with the front truck, the rear truck 50*b* is supported at each end by the base of the front beam 34 of the rear brace 26 and the lowe end of the leg 44 of the support section 40. Similarly, the shank 54*b* is attached to the torsional member 52*b* just forward of its center to form essentially a right angle and is attached at its opposite end to the axle mount 56*b*. As shown clearly in FIG. 4, the torsional members 52 in the preferred embodiment are cylindrical, although other shapes may be used.

FIGS. 3 and 4 illustrate that the shank members 54 are rectangular in cross-section, with the longer side lying transverse to the plate 20. This shape allows the front and rear shanks 54*a* and 54*b* to flex forward and rearward, respectively, in response to bumps or other irregularities in the skating surface. More importantly, the suspension system of the chassis of the present invention is enhanced by resiliency of the torsional members 52 which serve as excellent shock absorbers since they are supported at each end and the shanks 54 attached approximately at their centers. In this regard, the thickness of the members 52 can be increased or decreased depending upon the weight of the individual skater.

Referring again to FIGS. 2 and 3, a stop 62 is attached at one end near the point of the front brace 24 and extends downwardly toward the axle mount 56. Similarly, behind front truck 50*a* another stop 64 is attached at one end to leg 42 of the support section 40 and extends forwardly toward axle mount 56. In like manner, a pair of stops 66 and 68 are attached to the rear leg 44 and rear brace 26 respectively, and angle toward one another and the rear axle mount 56*b*. The free ends of each of these stops 62, 64, 66, and 68, are spaced above small tabs 60 located approximately midway between the wheels on the front and rear surfaces of the axle mounts 56. As will be described in more detail below, these tabs, in cooperation with stops 62, 64, 66 and 68, limit the sharpness of the turning angle of a roller skate having the chassis of the present invention.

The manner in which the chassis 14 of the present invention enables the skate 10 to turn can be best described by reference to FIGS. 5, 6 and 7. The trucks 50 of the present invention turn in conventional manner when the skater shifts his weight or leans to one side or the other, as shown in FIG. 6. For example, if the skater leans to his left, as in FIG. 6, the axes 70 of the axles 58, originally in positions 70*a* and 70*b*, tend to converge toward one another on the left side, as shown in FIG. 5 by axes positions 70*a'* and 70*b'*, thereby allowing the wheels to affect a left turn. This convergence of the wheels toward one another on the side of the turn is made possible by the opposite inclination of the torsional members 52 relative to the foot plate 20, and the extent of this convergence produces the turning angle of the roller skate.

The manner in which a roller skate turns can be more easily described if one considers the relative movement between an axle 58 and the plate 20, as shown in FIG. 7. That is, as a skater leans in one direction or another, the plate 20 tends to tilt to that side, as shown in FIG. 6, while the axle remains horizontal, parallel to the ground. However, by assuming the reverse, that is, that the axle tilts towards the plate which remains horizontal, the convergence of the axles toward one another on the side of a turn is more easily explained.

FIG. 7 is a schematic view of the front portion of the chassis 14 of the present invention illustrating only portions of the plate 20, the torsional member 52*a* and the ends of the axle 58*a* relative to the plate 20 under the above assumption. Thus, prior to turning both the left end 58*a'* and the right end 58*a''* of the axle 58*a* are aligned in position 58*a*, perpendicular to the longitudinal dimension of the plate 20 and defining a plane parallel to the plane thereof.

As a skater's weight is shifted to the left, the axle 58*a* will become inclined toward the plate 20; however, the rotation of the axle will be about the axis 72*a* of the torsional member 52*a* and the displacement of each end of the axle will be in a plane, indicated at 74*a*, at right angles to said axis. Therefore, the left end 58*a'* of the axle is displaced upward and rearward from its original left position 58*a* and the right end 58*a''* correspondingly shifts downward and forward, as shown in FIG. 7. In summary, assuming the axle 58*a* rotates relative to the plate 20 during turning, and because the ends of the axle move in the plane defined by line 74, there is a total horizontal displacement, indicated by A, as well as a total vertical displacement, indicated by B.

Considering the turn as it actually occurs, with the plate 20 tilting and the axle 58 remaining horizontal, the total vertical displacement B, shown in FIG. 7, actually takes place in the inclination of the foot plate to the left, as shown in FIG. 6. However, the horizontal displacement A, results in the counter clockwise displacement of the front axle, indicated by its axis 70*a* in FIG. 5. Thus, the angle $\theta$a which opens towards the rear of the skate, enables the front axle 58*c* to rotate in the appropriate manner so as to affect a left turn when the skater's wheight is shifted to the left. In a like manner, $\theta$b, which angle opens toward the front of the skate, enables the rear axle 58*b* to be displaced clockwise, as indicated by the axis 70*b* in FIG. 5, when skater's weight is shifted to the left so as to effect a left turn.

It should also be noted that the degree of the turning angle of the roller skate is directly proportional to the acuteness of the angles $\theta$. That is, as that angle becomes less actue, less inclination of the plate 20 is required to produce the same horizontal displacement A and the same amount of turning shown in FIG. 5.

The function of the stops 62, 64, 66, and 68 shown in FIGS. 2 and 3, in limiting the turning angle of the roller skate, can now be explained. As the skater leans to one side or the other in a turn, contact by the free end of the stop on the upper surface of the tabs 60 will prevent the skater from leaning dangerously too far and possibly falling. However, because of the flexibility of the stops, if contact should be made with the tabs 60, a limited turn can still be accomplished without causing the skater to fall or otherwise injure himself.

An alternate truck embodiment is shown in FIG. 8 which illustrates the rear portion of a chassis 14. It consists solely of a shank member 76 which is attached at one end at the plate 20 and at the other end to the axle mount 56. The cross-section of the shank 76 can take on a variety of shapes; however, it is preferred that the narrow dimension of the cross-section be transverse to the longitudinal dimension of the plate 20 so as to allow the shank 76 to flex in the transverse direction.

The shank 76 turns generally in the same manner as the trucks 50, described above in connection with FIGS. 5, 6 and 7. As the plate 20 is inclined during turning, it tends to cause the shank 76 to flex about an axis which is perpendicular to its longitudinal axis 77, shown in FIG. 8. The precise vertical position of this axis of rotation is difficult to determine; however, the shank would flex approximately about the axis indicated at 79. This axis of rotation 79 is analogous to torsional member 52 and is inclined relative to plate 20 in the same manner. Thus, as described above in connection with the preferred truck embodiment 50, as the plate 20 tilts during turning, the relative rotation of the shank 76 about axis 79 will cause the axes 70 on the side of the turn to converge as shown in FIG. 8.

FIG. 9 is an exploded perspective view of a novel adjustable roller skate chassis 78. Adjustability in the chassis of the present invention is provided by two pair of interlocking beams, 80, 82 and 84, 86 which are slidably engaged with one another. The plate and truck assemblies from which these beams extend are identical to that described above except that the central narrow portion of the plate 20, the flange 46 and the web 48 are removed leaving two separate front and rear plate portions 20*a* and 20*b* from which are suspended the two truck assemblies 50*a* and 50*b*, respectively.

Extending rearwardly from the front leg 42 are two horizontal beams 80 and 82 which are spaced diagonally from one another. The upper beam 80 is essentially rectangular in cross-section and larger than the square cross-section of the lower beam 82. Similarly, extending forwardly from the rear leg 42 are two horizontal beams 84 and 86 which are also spaced diagonally with respect to each other and of an identical construction as that of beams 80 and 82. The two pair of diagonal beams are constructed so that when mated, as shown in FIG. 10, the upper beams 80 and 84 are adjacent one another and directly above these lower beams 82 and 86, which are also adjacent to one another. The mating surfaces of upper beams 80 and 84 are also provided with serations 88 which tend to prevent longitudinal movement of the two upper beams 80 and 84 relative to one another.

When the desired length for the chassis 78 is obtained, the two plate members 20*a* and 20*b* can be fixed relative to one another by insertion of a bolt 90 through slot 92 in the upper beam 80 and a hole 94 in the adjacent upper beam 84. The bolt 90 can then be secured in place by means of a nut 96, as shown in FIG. 10.

To provide additional security to the chassis 78, apertures 98 are provided in the legs 42 and 44 to receive the ends of the lower beams 82 and 86. The apertures 98 will prevent the lower beams 82 and 86, and also the upper beams 80 and 84, from movement in the horizontal and vertical direction. Similarly, apertures 99 are cut out of legs 42 and 44 (although only one such aperture 99 is shown in FIG. 9) and receive the ends of upper beams 80 and 84.

Preferably, each pair of beams will form a part of the unitary plastic molded construction of the respective individual chassis members which together make up the complete adjustable chassis 78. Thus, the advantages of this type of construction are combined with the advantages of an adjustable roller skate chassis to yield a roller skate which is superior to the prior art.

The adjustability feature of the present invention can be used in combination with either truck embodiment 50 or 76 disclosed herein, or any other truck. As merely one example of the preferred truck 50, torsional member 52 has a circular diameter of ⅜ inch, length of 1⅜ inch and makes an angle $\theta$ of 15° with respect to the plate 20. A chassis having a truck of these dimensions will display adequate characteristics of turning for an average adult, however, these dimensions can be varied depending upon the weight and shoe size of the individual skater. Furthermore, even within each weight class, other examples of truck dimensions will be readily apparent to one skilled in the art which will allow the principles and advantages of the present invention to be fully practiced.

In summary, the roller skate chassis of the present invention is inexpensive, unitary, and of a one-piece plastic molded construction, which can also be modified to be adjustable, and which is comparable to chassis of the prior art in terms of speed and manuverability.

What is claimed is:

1. An adjustable roller skate chassis comprising:
a first chassis;
second chassis; and
means for selectively adjusting the distance between said first and second chassis, said means comprising first and second forks, one attached to each of said chassis and extending parallel to the longitudinal dimension of said chassis, the prongs of each fork being offset diagonally relative to one another such that a prong of said first fork, is above a prong of said second fork while the other prong of said first fork is below the other prong of said second fork, all of said prongs having substantially equal lengths, and said forks slidably mating.

2. The adjustable roller skate chassis of claim 1 further comprising means for locking said forks in longitudinal position relative to each other.

3. The adjustable roller skate chassis of claim 2 wherein said locking means comprises a bolt inserted through apertures in adjacent prongs.

4. The adjustable roller skate chassis of claim 1 wherein at least one prong on said first fork and one prong on said second fork are adjacent one another and each are serrated on their mating surfaces.

5. The adjustable roller skate chassis of claim 1 wherein at least one prong of said first fork is inserted into an aperture in said second chassis.

6. The adjustable roller skate chassis of claim 1 wherein said first and second chassis are each unitary and are molded from plastic.

7. The adjustable roller skate chassis of claim 6 wherein each said fork is an integral part of its respective chassis.

8. A unitary roller skate chassis comprising:
a foot plate;
front, rear and central support members attached to the bottom of said foot plate;
a front truck mounted between said front support member and said central support member; and
a rear truck mounted between said central support member and said rear support member, each truck comprising a substantially cylindrical torsional member having a longitudinal axis extending along the length of said plate and inclined with respect thereto, said torsional member rotating about its axis during turning, and a transverse axle mount which is joined to said torsional member by a shank, said trucks, said support members and plate being integral with one another to form a unitary one-piece chassis.

9. The roller skate chassis fo claim 8, wherein said unitary chassis is molded from plastic.

10. The roller skate chassis of claim 8 wherein said torsional member is flexible in a direction transverse to its axis and said shank is attached to said torsional member near its middle, thereby providing shock absorption for said chassis.

11. The roller skate chassis of claim 8, wherein said axle mounts include small tabs spaced below stops which are attached to said support members, said tabs and said stops working in cooperation to limit the turning movement of said chassis.

12. A unitary, plastic molded skate chassis comprising:

a support plate;

dual skate trucks attached to the bottom of said plate and integral therewith to form a one-piece plastic chassis, each said truck comprising:

a strut-like torsional member support only at each end beneath said plate having a longitudinal axis extending along the length thereof and inclined with respect thereto;

said torsional member being sufficiently flexible in a rotational direction to permit it to rotate about its axis responsive to a shift in weight by a person standing on said plate, thereby causing said chassis to turn;

a shank integral with said torsional member and attached generally midway between its ends; and means for receiving roller skate wheels integral with said shank.

13. The unitary, plastic molded chassis of claim 12 wherein said flexibility of said torsional member includes sufficient bending flexibility in a direction transverse to its axis to permit said torsional member to flex in response to uneven vertical forces transmitted through said wheels, thereby absorbing said forces.

14. A unitary, plastic-molded skate chassis comprising: a support plate; and dual skate trucks integral with said plate to form a chassis of a one-piece plastic molded construction, each said truck comprising:

a substantially non-planar torsional member integral with and supported at its ends beneath said plate to prevent rotation of said ends, said torsional member forming an angle with the horizontal;

means for receiving said roller skate wheel; and means integral with said torsional member and said receiving means for connecting said torsional member to said receiving means;

said chassis being sufficiently flexible to permit a portion of said torsional member intermediate said ends to rotate about the axis of said torsional member in response to the tilting of said plate to provide substantially the sole means for turning said chassis.

15. A unitary, plastic molded skate chassis, comprising:

a support plate; and dual skate trucks integral with said plate, each said truck having a torsional member and means for mounting said torsional member beneath said plate such that the ends of said torsional member are non-rotatable and a portion intermediate said ends is permitted to rotate about its axis in response to the tilting of said plate to provide substantially the only means for turning said chassis.

16. The plastic-molded skate chassis of claim 15 wherein the distance separating said trucks is adjustable.

17. A unitary, plastic-molded skate chassis comprising:

a support plate;

means for receiving a roller skate axle; and a torsional member supported at its ends beneath said plate for rotation about an axis inclined with respect to the horizontal to provide substantially the sole means for turning said truck;

said torsional member being sufficiently flexible to permit it to bend at a location between said ends to provide means for absorbing shocks and forces exerted on said truck through roller skate wheels attached to said axle.

* * * * *